US009405229B1

(12) United States Patent
Nose et al.

(10) Patent No.: US 9,405,229 B1
(45) Date of Patent: Aug. 2, 2016

(54) DEVELOPING DEVICE

(71) Applicant: CANON KABUSHIKI KAISHA, Tokyo (JP)

(72) Inventors: Katsuya Nose, Kashiwa (JP); Fumiyoshi Saito, Toride (JP); Toshihisa Yago, Toride (JP); Naoki Mugita, Toride (JP); Yusuke Ishida, Toride (JP); Kosuke Takeuchi, Abiko (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/002,910

(22) Filed: Jan. 21, 2016

(30) Foreign Application Priority Data

Jan. 22, 2015 (JP) ..... 2015-010627

(51) Int. Cl.
*G03G 15/08* (2006.01)

(52) U.S. Cl.
CPC ..... *G03G 15/0891* (2013.01)

(58) Field of Classification Search
CPC ..... G03G 15/0891
USPC ..... 399/254, 258
See application file for complete search history.

(56) References Cited

U.S. PATENT DOCUMENTS 8,649,708 B2 * 2/2014 Watanabe ..... G03G 15/0189 399/254
8,750,764 B2 6/2014 Okuno et al.
9,217,957 B2 12/2015 Ishida
2009/0010662 A1 * 1/2009 Naoi ..... G03G 15/5004 399/44
2015/0003876 A1 1/2015 Iida et al.
2015/0139696 A1 5/2015 Ishida et al.
2015/0139697 A1 5/2015 Tsukijima et al.
2015/0253694 A1 9/2015 Saito
2016/0004182 A1 1/2016 Yago et al.

FOREIGN PATENT DOCUMENTS

JP 2010-237328 A 10/2010
JP 2010-237329 A 10/2010
JP 2012-150316 A 8/2012

OTHER PUBLICATIONS

Naoki Mugita et al., U.S. Appl. No. 15/001,433, filed Jan. 20, 2016.
Fumiyoshi Saito et al., U.S. Appl. No. 14/964,841, filed Dec. 10, 2015.
Toshihisa Yago et al., U.S. Appl. No. 14/789,424, filed Jul. 1, 2015.

* cited by examiner

*Primary Examiner* — David Bolduc
*Assistant Examiner* — Barnabas Fekete
(74) *Attorney, Agent, or Firm* — Fitzpatrick, Cella, Harper & Scinto

(57) ABSTRACT

A developing device includes a developer carrying member, a first chamber, a second chamber, a first feeding member, and a second feeding member. The second feeding member includes first to third spiral portions and a disk portion. The disk portion includes a projected portion. When the disk portion is seen in an axial direction of the second feeding member, on the basis of a line connecting a rotation center of the disk portion and an upstream end portion of the third spiral portion with respect to a feeding direction of the third spiral portion, the projected portion is provided within a range from a position deviated by 90 degrees toward a downstream side with respect to a rotational direction of the disk portion to a position deviated by 30 degrees toward an upstream side with respect to the rotational direction of the disk portion.

7 Claims, 5 Drawing Sheets

DEVELOPING DEVICE

FIELD OF THE INVENTION AND RELATED ART

The present invention relates to a developing device used in an image forming apparatus employing an electrophotographic type or an electrostatic recording type, and particularly relates to the developing device for feeding the developer in a developing container to a discharge opening to discharge the developer to an outside of the developing container through the discharge opening.

In the developing device used in the image forming apparatus such as a copying machine, a printer, a facsimile machine or a multi-function machine, a one-component developer consisting of a toner alone or a two-component developer consisting of the toner and a carrier (hereinafter, these developers are simply referred to as a developer). These developers are consumed by being subjected to development, and therefore a toner charge amount of the developer remaining in the developing container lowers. When the toner charge amount lowers, an image defect such as scattering fog or the like is liable to generate. Therefore, a developing device in which in order to prevent the lowering in toner charge amount, not only a fresh developer is supplied but also an excessive developer is discharged through the discharge opening has been conventionally known.

As such a developing device, a developing device provided with a discharge opening at a downstreammost portion of a developing container with respect to a feeding screw for feeding the developer in the developing container has been proposed (Japanese Laid-Open Patent Application 2010-237328). In this developing device, a feeding screw includes a first spiral portion, a second spiral portion and a third spiral portion which are provided at remoter positions from the discharge opening in the listed order. The first spiral portion and the third spiral portion are provided so as to feed the developer toward the discharge opening, and the second spiral portion is provided so as to feed the developer in an opposite direction to a feeding direction of the first and third spiral portions. As a result, of the developer fed by the first spiral portion, only the developer reaching the third spiral portion against a pushing-back force by the second spiral portion can be discharged through the discharge opening, so that the developer in an amount more than necessary is prevented from being discharged to an outside of the developing container.

Further, in order to prevent discharge of the developer in the amount more than necessary even when a rotational speed of the feeding screw changes, a disk portion is provided between the second spiral portion and the third spiral portion.

The disk portion provided between the second and third spiral portions is provided with a projected portion at an outer peripheral surface thereof. This projected portion is provided for preventing a decrease in amount of the developer discharged through the discharge opening in the case where a flowability of the developer lowers. That is, when the flowability of the developer lowers, the developer agglomerates around the second spiral portion to form an agglomerate (aggregate). This agglomerate blocks a feeding path of the developer and impairs the discharge of the developer. As a result, the amount of the developer discharged through the discharge opening decreases and thus the developer amount in the developing container becomes excessive, so that inconveniences such as generation of density non-uniformity and fog and overflow of the developer from the developing container can occur. Therefore, by forming the projected portion on the outer peripheral surface of the disk portion, even when the agglomerate is formed, the agglomerate can be quickly disintegrated.

However, in such a case that a continuous operation is performed for a long time in a high temperature/high humidity environment (in this case, the flowability of the developer particularly in the developing container lowers), the amount of the developer discharged through the discharge opening largely decreased in some instances. When the present inventors observed the flow of the developer in the developing container (specifically in the stirring chamber), it was found out that this decrease was caused by another agglomerate formed around the third spiral portion close to the disk portion. That is, when the agglomerate formed around the second spiral portion is disintegrated, the developer forming the agglomerate is fed toward the disk portion and the third spiral portion which are disposed on a downstream side with respect to the feeding direction. At this time, the developer in a large amount is fed at once, and therefore in the neighborhood of the disk portion and the third spiral portion, a new agglomerate is liable to be formed around the third spiral portion, so that the newly formed agglomerate impairs smooth discharge of the developer. For that reason, the amount of the developer discharged through the discharge opening largely decreased.

SUMMARY OF THE INVENTION

The present invention has been accomplished in view of the above-described circumstances. A principal object of the present invention is to provide a developing device capable of stably effecting discharge of a developer by smoothly feeding the developer even when a flowability of the developer lowers.

According to an aspect of the present invention, there is provided a developing device comprising: a developer carrying member for carrying and feeding a developer; a first chamber for supplying the developer to the developer carrying member; a second chamber for forming a circulation path of the developer in communication with the first chamber and for delivering the developer between itself and the first chamber; a first feeding member, provided rotatably in the first chamber, for feeding the developer in the first chamber; and a second feeding member, provided rotatably in the second chamber, for feeding the developer in the second chamber, wherein the second feeding member comprises, a first spiral portion including a first spiral feeding blade for feeding the developer in the second chamber in a feeding direction opposite to a feeding direction in the first chamber, a second spiral portion including a second spiral feeding blade for feeding a part of the developer fed by the first spiral portion in a feeding direction opposite to the feeding direction of the first spiral portion, a third spiral portion including a third spiral feeding blade for feeding the developer fed by getting over the second spiral portion in the same feeding direction as the feeding direction of the first spiral portion, and a disk portion provided between the second spiral portion and the third spiral portion, wherein the disk portion includes a projected portion projected from a part of an outer peripheral surface of the disk portion in a radial direction, and wherein when the disk portion is seen in an axial direction of the second feeding member, on the basis of a line connecting a rotation center of the disk portion and an upstream end portion of the third spiral portion with respect to the feeding direction of the third spiral portion, the projected portion is provided within a range from a position deviated by 90 degrees toward a downstream side with respect to a rotational direction of the disk portion to a position deviated by 30 degrees toward an upstream side with respect to the rotational direction of the disk portion.

Further features of the present invention will become apparent from the following description of exemplary embodiments with reference to the attached drawings.

DESCRIPTION OF THE EMBODIMENTS

Figure 1:
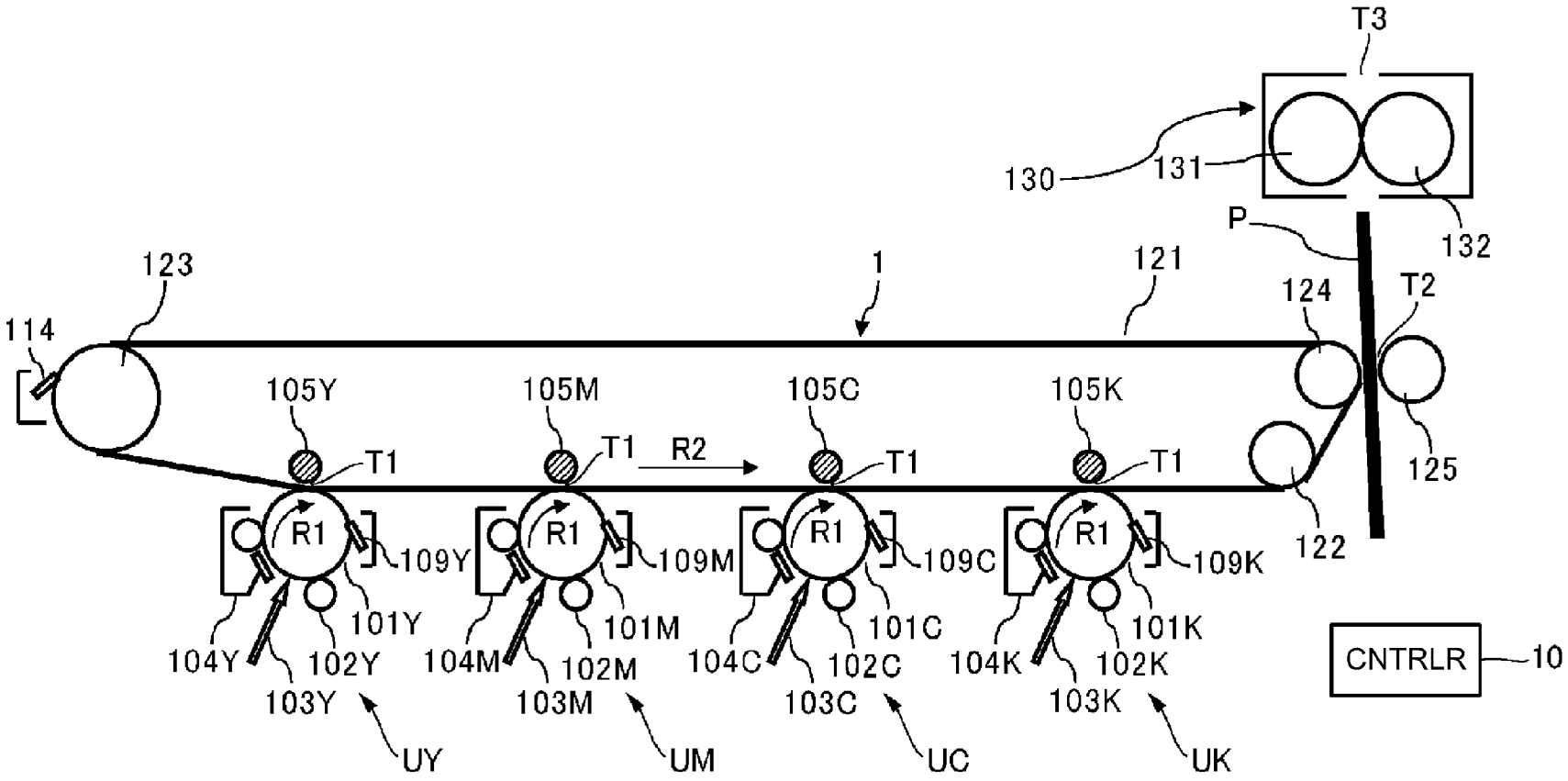
FIG. 1 is a schematic illustration of a structure of an image forming apparatus including a developing device according to the present invention.

A developing device according to an embodiment of the present invention will be described. First, a general structure of an image forming apparatus including the developing device according to the present invention will be described with reference to FIG. 1. An image forming apparatus 1 shown in FIG. 1 is an intermediary transfer type full color printer of a tandem type in which image forming portions UY, UM, UC and UK are arranged along an intermediary transfer belt 121.

<Image Forming Apparatus>

At the image forming portion UY, a yellow toner image is formed on a photosensitive drum 101Y and then is transferred onto the intermediary transfer belt 121. At the image forming portion UM, a magenta toner image is formed on a photosensitive drum 101M and then is transferred onto the intermediary transfer belt 121. At the image forming portion UC and UK, cyan and black toner images are formed on photosensitive drums 101C and 101K respectively, and then are transferred onto the intermediary transfer belt 121. The four color toner images transferred on the intermediary transfer belt 121 are fed to a secondary transfer portion T2 and are secondary-transferred collectively onto a recording material P (sheet material such as a sheet or an OHP sheet).

The image forming portions UY, UM, UC and UK have the substantially same construction except that colors of toners used in developing devices 104Y, 104M, 104C and 104K, respectively, are yellow, magenta, cyan and black, respectively. In the following constituents of the image forming portions are represented by reference numerals or symbols from which suffixes Y, M, C and K for representing a difference in color for the image forming portions UY, UM, UC and UK, and constitutions and operations of the image forming portions U will be collectively described.

The image forming portion U includes, at a periphery of the photosensitive drum 101 as an image bearing member, a primary charging device 102, an exposure device 103, the developing device 104, a transfer charging device 105 and a drum cleaning device 109. The photosensitive drum 101 and a drum cleaning device 109. The photosensitive drum 101 is prepared by forming a photosensitive layer on an outer peripheral surface of an aluminum cylinder, and is rotated in an arrow R1 direction at a predetermined process speed.

The primary charging device 102 is, e.g., a roller-shaped charging roller and electrically charges the photosensitive drum 101 to a uniform negative dark portion potential in contact with the photosensitive drum 101 under application of a charging bias voltage. The exposure device 103 generates a laser beam, from a laser beam emitting element, obtained by subjecting scanning line image data which is developed from an associated color component image to ON-OFF modulation and then to scanning through a rotating mirror, so that an electrostatic image for an image is formed on the surface of the charged photosensitive drum 101. The developing device 104 supplies the toner to the photosensitive drum 101 and develops the electrostatic image into the toner image.

The transfer charging device 105 is disposed opposed to the photosensitive drum 101 via the intermediary transfer belt 121 and forms a toner image primary transfer portion T1 between the photosensitive drum 101 and the intermediary transfer belt 121. By applying a transfer bias to the transfer charging device 105 at the primary transfer portion T1, the toner image is primary-transferred from the photosensitive drum 101 onto the intermediary transfer belt 121. The drum cleaning device 109 rubs the photosensitive drum 101 with a cleaning blade and collects a primary transfer residual toner slightly remaining on the photosensitive drum 101 after the primary transfer.

The intermediary transfer belt 121 is extended around and supported by a driving roller 122, a tension roller 123, an inner secondary transfer roller 124 and the like, and is driven by the driving roller 122, so that the intermediary transfer belt 121 is rotated in an arrow R2 direction in FIG. 1. A secondary transfer portion T2 is a toner image transfer nip onto a recording material P formed by contact of an outer secondary transfer roller 125 with the intermediary transfer belt 121 stretched by the inner secondary transfer roller 124. At the secondary transfer portion T2, by applying a secondary transfer bias to the outer secondary transfer roller 125, the toner image is secondary-transferred from the intermediary transfer belt 121 onto the recording material P fed to the secondary transfer portion T2. A secondary transfer residual toner remaining on the intermediary transfer belt 121 while being deposited on the intermediary transfer belt 121 is collected by rubbing the intermediary transfer belt 121 with a belt cleaning device 114.

The recording material P on which the four color images are secondary-transferred at the secondary transfer portion T2 is fed to a fixing device 130. The fixing device 130 forms a fixing nip T3 by contact between fixing rollers 122*a* and 122*b*, and at the fixing nip T3, the toner image is fixed on the recording material P while feeding the recording material P. In the fixing device 130, the fixing nip T3 is formed by causing the fixing roller 122*b* to be press-contacted by an urging mechanism (not shown) to the fixing roller 122*a* heated from an inside by a lamp heater (not shown). By nipping and feeding the recording material P at the fixing nip T3, the toner image is heated and pressed, so that the toner image is fixed on the recording material P. The recording material P on which the toner image is fixed by the fixing device 130 is discharged to an outside of the image forming apparatus 1.

<Controller>

Figure 2:
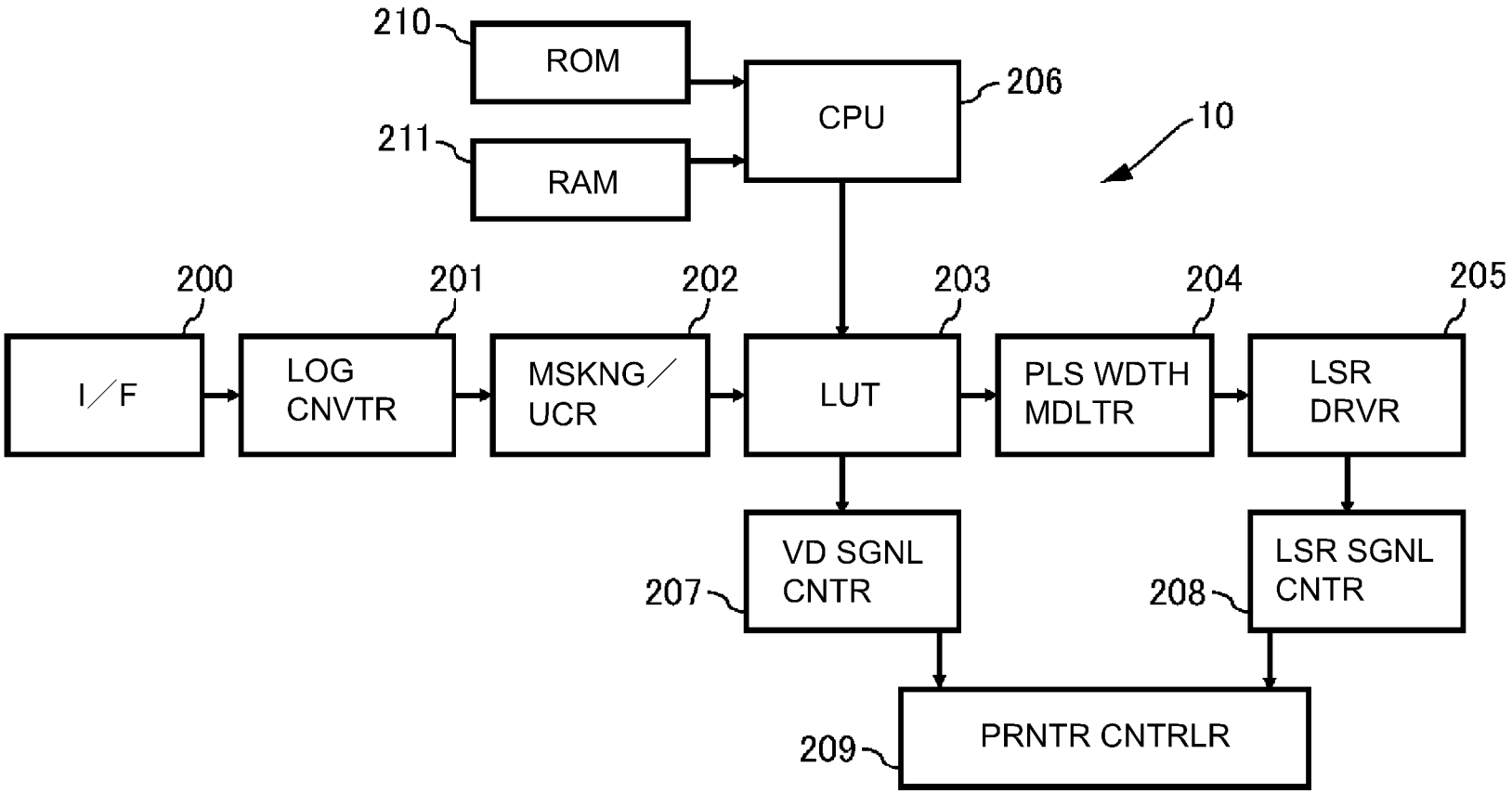
FIG. 2 is a block diagram showing a system constitution of a controller.

The image forming apparatus 1 includes a controller 10. The controller 10 will be described using FIG. 2. A system constitution of the controller 10 is shown in FIG. 2. As shown in FIG. 2, the controller 10 includes a CPU 206. The CPU 206 executes various software programs such as an image control program stored in a ROM 210, and collectively controls respective blocks described below with execution of the programs. A RAM 211 temporarily stores control data, and is used as an operation region of computation with the execution of the programs.

Through an external input interface (I/F) 200, color image data as RGB image data are inputted from an unshown external device such as an original scanner or a computer (information processing device) as desired which are connected with the external input interface 200 so that data communication is enabled. A LOG conversion portion 201 converts luminance data of the RGB form image data inputted through the external input interface 200 into CMYK form density data (CMYK image data) on the basis of a look-up table (LUT) constituted (prepared) by data or the like stored in an ROM 210. A masking/UCR portion 202 extracts a black (K) component data from the converted CMYK image data and subjects CMRK image data to matrix operation in order to correct color shading of a recording colorant. A look-up table portion (LUT portion) 203 causes the CMYK image data to coincide with an ideal gradation characteristic of a printer portion controller 209, and specifically makes density correction of the inputted CMYK image data every color by using a gamma (γ) look-up table. Incidentally, the γ look-up table is prepared on the basis of the data developed on an ROM 211 and the contents of the table are set by a CPU 206. A pulse width modulation portion 204 outputs a pulse signal with a pulse width corresponding to the CMYK image data (image signal) inputted from the LUT portion 203. On the basis of this pulse signal, a laser driver 205 drives the laser emitting element 103Y of the exposure device 103 to irradiate the surface of the photosensitive drum 101 with laser light, so that the electrostatic image is formed on the surface of the photosensitive drum 101.

A video signal count portion 207 is a circuit for adding up a level for each pixel (0 to 255 level) for a screenful of the image with respect to 600 dpi of the CMYK image data inputted into the LUT portion 203. The integrated value of the image data is referred to as a video count value. A maximum of this video count value is 1023 in the case where all the pixels for the output image are at the 255 level. Incidentally, when there is a restriction on the constitution of the circuit, by using a laser signal count portion 208 in place of the video signal count portion 207, the image signal from the laser driver 205 is similarly calculated, so that it is possible to obtain the video count value. A signal for the video count value is inputted into the printer controller 209. On the basis of the signal, the printer controller 209 effects various pieces of control such as control of rotational speeds of a developing sleeve 24 and developing screws 22*a* and 22*b* described later.

<Developing Device>

Figure 3:
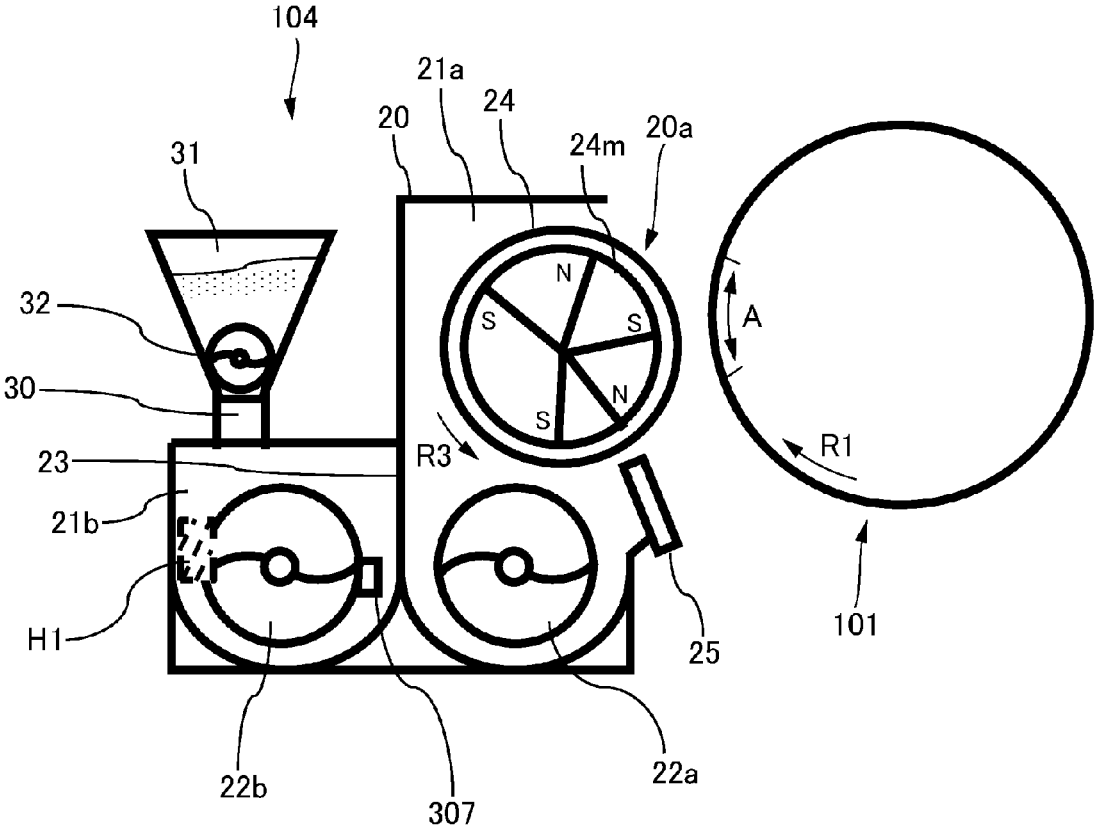
FIG. 3 is a side sectional view showing a structure of the developing device in cross section perpendicular to a shaft (axis).

The constitution of the developing device 104 will be described using FIGS. 3 and 4. The developing device 104 shown in FIG. 3 is of a horizontal stirring type in which a developing chamber 21*a* and a stirring chamber 21*b* which are described later are horizontally provided. The developing device 104 includes a developing container 20 forming a housing, the developing sleeve 24 as a developer carrying member and the regulating blade 25 as a regulating member are provided.

As shown in FIG. 3, the developing sleeve 24 as a developer carrying member is partly exposed through an opening 20*a* of the developing container 20 provided at a position opposing the photosensitive drum 101 and is provided rotatably in the developing container 20. The developing sleeve 24 rotates in an arrow R3 direction in FIG. 3 while carrying the developer having a layer thickness regulated by the regulating blade 25, and feeds the developer to the opposing photosensitive drum 101. The developing sleeve 24 is 20 mm in diameter for example, and the photosensitive drum 101 is 30 mm in diameter for example. A gap between these members in a closest region therebetween was about 300 μm. As a result, the photosensitive drum 101 is rubbed with the developer fed into a developing region A. Thus, the toner is supplied to the electrostatic image formed on the photosensitive drum 101, so that the electrostatic image is developed into the toner image.

The developing sleeve 24 is formed in a cylindrical shape using a non-magnetic material such as aluminum or stainless steel, and inside the developing sleeve 24, a magnet roller 24*m* as a magnetic field generating means is fixedly provided. By a magnetic force of the magnet roller 24*m*, on the surface of the developing sleeve 24, a magnetic chain (magnetic brush) of the developer is formed. A layer thickness of the magnetic chain formed on the surface of the developing sleeve 24 is regulated by the regulating blade 25, and then the developer is fed into the developing region A. The regulating blade 25 is a plate-like member formed of a non-magnetic material such as aluminum, and is disposed upstream of the photosensitive drum 101 with respect to a rotational direction of the developing sleeve 24 along a longitudinal direction of the developing sleeve 24. The regulating blade 25 is disposed opposed to the developing sleeve 24 so that a free end thereof is directed toward a rotation center of the developing sleeve 24. By adjusting a spacing (gap) between the free end of the regulating blade 25 and the surface of the developing sleeve 24, a cutting amount of the magnetic chain formed on the surface of the developing sleeve 24 is adjusted, so that a coating amount of the developer fed to a developing region A is adjusted. The developing sleeve 24 is 20 mm in diameter for example, and the photosensitive drum 101 is 30 mm in diameter for example. A gap between these members in a closest region therebetween was about 300 μm. As a result, the photosensitive drum 101 is rubbed with the developer fed into a developing region A. Thus, the toner is supplied to the electrostatic image formed on the photosensitive drum 101, so that the electrostatic image is developed into the toner image.

The developing sleeve 24 is formed in a cylindrical shape using a non-magnetic material such as aluminum or stainless steel, and inside the developing sleeve 24, a magnetic roller 24*m* as a magnetic field generating means is fixedly provided. By a magnetic force of the magnet roller 24*m*, on the surface of the developing sleeve 24, a magnetic chain (magnetic brush) of the developer is formed. A layer thickness of the magnetic chain formed on the surface of the developing sleeve 24 is regulated by the regulating blade 25, and then the developer is fed into the developing region A. The gap at the closest position between the regulating blade 24 and the developing sleeve 24 is set at 200-1000 μm, preferably 300-700 μm. In the developing device 104 in this embodiment, the gap is set at 500 μm, so that a coating amount per unit area of the developer on the developing sleeve 24 is regulated to about 30 mg/cm$^2$ for example.

The developing sleeve 24 rotates in the same direction (arrow R3 direction) at an opposing surface to the photosensitive drum 101 while carrying the developer regulated in layer thickness by cutting the magnetic chain with the regulating blade 25, and thus feeds the carried developer into the developing region A. For example, the peripheral speed of the photosensitive drum 101 is 300 mm/sec, and the peripheral speed of the developing sleeve 24 is 540 mm/sec, i.e., is 1.8 times the peripheral speed of the photosensitive drum 101. A peripheral speed ratio of the developing sleeve 24 to the photosensitive drum 101 may be set normally between 0.3-3.0 (times), preferably between 0.5-2.0 (times). A developing efficiency is enhanced with a larger peripheral speed ratio, but when the peripheral speed ratio is excessively large, problems such as the toner scattering, a deterioration of the developer, and the like are liable to generate, and therefore the peripheral speed ratio may preferably be set within a range of 0.5-2.0 (times).

The photosensitive drum 101 is rubbed with a free end of the magnetic chain formed by a developing pole of the magnet roller 24*m* in the developing region A, so that the toner is supplied to the electrostatic latent image formed on the photosensitive drum 101 and thus the electrostatic latent image is developed into the toner image. At this time, in order to improve the developing efficiency, i.e., an imparting ratio of the toner to the electrostatic latent image, to the developing sleeve 24, a developing bias voltage in the form of a DC voltage biased with an AC voltage is applied from an unshown voltage source (power source). For example, an oscillating voltage in the form of a DC voltage of −500 V biased with an AC voltage of 1800 V in peak-to-peak voltage and 12 kHz in frequency is applied. A DC voltage value and an AC voltage value are not limited to the above-described values. In a magnetic brush developing method using the above-described two-component developer, when the AC voltage is applied, the developing efficiency increased and thus a high image quality is obtained, but instead thereof, the image defect such as the fog is liable to generate. Therefore, a potential difference is provided between the DC voltage applied to the developing sleeve 24 and the charge potential (i.e., a white background potential) of the photosensitive drum 101, so that generation of the image defect such as fog is made difficult.

<Two-Component Developer>

In the above-described developing device 104, the two-component developer containing a negatively chargeable toner (non-magnetic) and a positively chargeable carrier is used, and will be described.

The toner includes colored particles comprising a binder resin such as a styrene-based resin material or a polyester resin material, a colorant such as carbon black, a dye or a pigment, colored resin particles containing another additive as desired, and an external additive such as colloidal silica. With respect to a volume-average particle size of the toner, when the particle size is excessively small, the toner does not readily produce friction with the carrier and therefore the charge amount is not readily controlled. When the particle size is excessively large, a fine toner image cannot be formed, and therefore the volume-average particle size may preferably be 4 μm-10 μm, further preferably be 8 μm or less. In recent years, in order to improve a fixing property, a toner having a low melting point or a toner having a low glass transition point (70° C. or less for example) is used. Further, in order to improve a parting property after the fixing, a wax-containing toner is used. In the developing device 104 in this embodiment, a pulverization toner containing a wax is used.

The volume-average particle size of the toner was measured by using the following device and method. As the measuring device, a sheath-flow electric resistance type particle size distribution measuring device ("SD-2000", manufactured by Sysmex Corp.) was used. The measuring method was as follows. To 100-150 ml of an electrolytic solution which is a 1%-aqueous NaCl (sodium chloride) solution prepared using reagent-grade sodium chloride, 0.1 ml of a surfactant as a dispersant, preferably, alkylbenzenesulfonic acid salt, was added, and to this mixture, 0.5-50 mg of a toner as a measurement sample was added.

Then, the electrolytic solution in which the toner was suspended was dispersed for about 1-3 minutes in an ultrasonic dispersing device. Then, the particle size distribution of the toner, the size of which is in the range of 2-40 μm was measured with the use of the above-mentioned measuring device ("SD-2000") fitted with a 100 μm aperture, and the volume-average distribution was obtained. Then, a volume-average particle size was obtained from the thus-obtained volume-average distribution.

As a material for the carrier, surface-oxidized or non-oxidized particles of a metallic substance such as iron, nickel, cobalt, manganese, chrome, rare-earth metal and their alloys, or oxidized ferrite, and the like can be suitably used. A manufacturing method of these magnetic particles is not particularly limited. The carrier has a volume-average particle size of 20-60 μm, preferably 30-50 μm. The carrier has a resistivity of $10^7$ Ωcm or more, preferably $10^8$ Ωcm or more. In the developing device 104 in this embodiment, the magnetic carrier having the resistivity of $10^8$ Ωcm is used.

The resistivity of the carrier was measured by a method in which the resistivity is obtained on the basis of a current flowing through a circuit under application of a voltage in a state in which one of electrodes is pressed.

Specifically, the resistivity was measured in the following manner. That is, a cell of the sandwich type, which was 4 $cm^2$ in the area (size) of each of its measurement electrodes, and was 0.4 cm in the gap between the electrodes, was used. In a state in which 1 kg of weight was applied to one of the electrodes and a voltage E (V/cm) was applied between the two electrodes. Further, the volume-average particle size of the magnetic carrier was measured with the use of a particle size distribution measuring device ("HERO", mfd. by JEOL Ltd.) of the laser diffraction type. The particle size range of 0.5-350 μm was, based on volume basis, logarithmically divided into 32 decades, and the number of particles in each decade was measured. Then, from the results of the measurement, the median diameter of 50% in volume was used as the volume-average particle size of the magnetic carrier.

<Developing Container>

An inside of the developing container 20 for accommodating the two-component developer containing the toner and the carrier is partitioned, as shown in FIG. 3, with respect to a horizontal direction into a right-side developing chamber 21*a* and a left-side stirring chamber 21*b* by a partition wall 23 extending in a vertical direction at a substantially central portion. As shown in FIG. 4, the developing chamber 21*a* and the stirring chamber 21*b* communicate with each other through communicating portions 26 and 27 provided at both end portions of the partition wall 23, and form a circulation path of the developer.

In chambers consisting of the developing chamber 21*a* as a first chamber and the stirring chamber 21 as a second chamber, the developing screw 22*a* as a first feeding means and the stirring screw 22*b* as a second feeding means are rotatably provided. Each of the developing screw 22*a* and the stirring screw 22*b* has a screw structure including a feeding blade provided spirally around a rotation shaft. Therefore, by rotation of the developing screw 22*a* and the stirring screw 22*b*, the developer is circulated and fed in the developing container 20 while being stirred. With the feeding of the developer while stirring the developer, the toner is negatively charged and the carrier is positively charged.

The developing screw 22*a* is disposed substantially in parallel with the developing sleeve 24 (FIG. 3) along the rotation shaft of the developing sleeve 24 in the developing chamber 21*a*, and the stirring screw 22*b* is disposed substantially in parallel with the developing screw 22*a* in the stirring chamber

21*b*. When the developing screw 22*a* rotates, the developer in the developing chamber 21*a* is fed in one direction from right to left in FIG. 4 along the rotation shaft of the developing screw 22*a*. The developer fed toward a downstream side of the developing chamber 21*a* with respect to a developer feeding direction is delivered to the stirring chamber 21*b* through the communicating portion 27. On the other hand, when the stirring screw 22*b* rotates, the developer in the stirring chamber 21*b* is fed in one direction from left to right in FIG. 3 along the rotation shaft of the stirring screw 22*b*, i.e., an opposite direction to the developer feeding direction in the developing chamber 21*a*. The developer fed toward a screw side of the stirring chamber 21*b* with respect to the developer feeding direction is delivered to the developing chamber 21*a* through the communicating portion 26. In this manner, the developer fed by rotation of the developing screw 22*a* and the stirring screw 22*b* is circulated and fed between the developing chamber 21*a* and the stirring chamber 21*b* through the communicating portions 26 and 27 provided at the both end portions of the partition wall 23. However, as described later specifically, in the case where the developer amount in the developing container 20 is large, a part of the developer fed by the stirring screw 22*b* is not delivered to the developing chamber 21*a* through the communicating portion 26 but is fed toward a side downstream of the communicating portion 26 with respect to the developer feeding direction.

<Supply of Developer>

In the developing device 104, the developer which is subjected to development on the developing sleeve 24 and which is lowered in toner charge amount is sufficiently mixed with a supplying developer (developer for supply) in the stirring screw 21*b*, so that the toner charge amount is restored and then the developer is returned to the developing chamber 21*a*. As a result, a toner content of the developer carried on the developing sleeve 24 is ensured at a certain level. The supplying developer containing both of the toner and the carrier is supplied from a developer supplying device 31 as a supplying portion. In the developing device 104, as the supplying developer, a developer in which the toner and the carrier were mixed at a weight ratio of 9:1 was used.

At an upper portion of the stirring chamber 21*b* in an upstream side of the stirring chamber 21*b* with respect to the developer feeding direction, a supply opening 30 is provided, and through this supply opening 30, the developer supplying device 21 is connected with the stirring chamber 21*b*. The developer supplying device 31 includes a supplying screw 32 having a screw structure. The supplying developer is supplied to the stirring chamber 21*b* through the supplying opening 30 by a rotational force of the supplying screw 32 and gravitation and is fed toward a downstream side with respect to the developer feeding direction by the stirring screw 22*b*. An amount of the supplying developer supplied from the developer supplying device 31 to the stirring chamber 21*b* is roughly determined by a number of rotations of the supplying screw 32. The number of rotations is determined by a toner supply amount control means (not shown) on the basis of a video count value obtained by a video signal counting portion 207 (FIG. 2) or a detection signal of a toner content sensor provided in the developing container 20. The toner supply amount control means adjusts the number of rotations in accordance with a ratio between the toner and the carrier calculated on the basis of the detection signal of a toner content sensor (not shown) so that the developer in an amount in which the toner content is about 10% in a weight ratio is supplied. In this way, the toner in an amount substantially corresponding to an amount of the toner consumed during the image formation is supplied.

<Discharge of Developer>

In the developing device 104, the supplying developer is supplied as described above, but when the amount of the developer in the developing container 20 becomes excessive, stirring of the developer becomes insufficient, so that density non-uniformity and fog generate or the developer overflows the developing container 20 in some cases. Therefore, in order to prevent an excessive amount of the developer in the developing container 20, the excessive developer is discharged from the developing container 20. This will be described using FIG. 5.

The stirring screw 22*b* for feeding the developer in the stirring chamber 21*b* includes a first spiral portion 301, a second spiral portion 302 and a third spiral portion 303 which are connected from an upstream side of the first spiral portion 301 toward a downstream side of the third spiral portion 303 with respect to the developer feeding direction in the listed order. The first spiral portion 301 is provided with a spiral-shaped first feeding blade 301*a* capable of feeding the developer in a direction from the communicating portion 27 to the communicating portion 26, and feeds the developer in the feeding direction along the circulation path in the stirring chamber 21*b*. The second spiral portion 302 is provided with a spiral-shaped second feeding blade 302*a* capable of feeding the developer in an opposite direction to the first feeding direction of the first spiral portion 301, and feeds a part of the developer so as to push back the developer from an outside to an inside of the circulation path in the stirring chamber 21*b*. That is, the second spiral portion 302 is a returning screw. These first and second spiral portions 301 and 302 are provided so that a connecting portion (joint) for connecting the first and second spiral portions 301 and 302 is disposed at a position opposing the communicating portion 26. Upstream of the second spiral portion 302 with respect to the feeding direction, a discharge opening 305 through which the developer is fed without being returned by the second spiral portion 302 is caused to pass toward the third spiral portion 303, which is provided with a spiral-shaped third feeding blade 303*c* capable of feeding the developer in an opposite direction to the feeding direction of the second spiral portion 302 (i.e., in the same direction as the feeding direction of the first spiral portion 301), and feeds the developer passed through the discharge opening 305. Downstream of the third spiral portion 303 with respect to the feeding direction, a discharge opening 306 permits discharge of the developer fed by the third spiral portion 303 to an outside of the developing container 20.

Each of the spiral portions rotates in the same direction at the same speed. Then, the developer is fed toward the discharge opening 306 by the first spiral portion 301, but most of the fed developer is returned back by the second spiral portion 302 to pass through the communicating portion 26, thus being delivered to the developing chamber 21*a*. On the other hand, a part of the developer which is not returned back by the second spiral portion 302 gets over the second spiral portion to reach the discharge opening 305 and then pass through the discharge opening 305. The developer passed through the discharge opening 305 is fed to the discharge opening 306 by the third spiral portion 303. In this manner, the developer fed to the discharge opening 306 is discharged as an excessive developer to the outside of the developing container 20 through the discharge opening 306.

<Balance Between Supply Amount and Discharge Amount>

The supply amount of the developer and the discharge amount of the developer are adjusted as described below, so that the developer amount in the developing container 20 is maintained at a certain level. The supplying developer is supplied in a supply amount in which the toner in an amount equal to an amount of the toner consumed by an output image and a patch image for control can be supplied. However, although the toner in the same amount is supplied, the supply amount fluctuates depending on a mixing ratio between the toner and the carrier which are contained in the supplying developer. That is, the supply amount increases with an increasing mixing ratio of the carrier. In this case, such a disadvantage that the supply amount increases and thus a running cost increases exists, but such an advantage that a fresh developer is supplied in a large amount and therefore a stable charge amount can be imparted always to the toner is obtained. On the other hand, the supply amount decreases with a decreasing mixing ratio of the carrier. In this case, such an advantage that the supply amount decreases and thus the running cost can be reduced, but such a disadvantage that a ratio of a deteriorated carrier contained in the developer in the developing container 20 increases and thus it becomes difficult to impart the stable charge amount to the toner exists. In general, the supplying developer of 0-20% (excluding 0%) in mixing ratio of the carrier is used, but in the developing device 104 in this embodiment, the supplying developer having the mixing ratio of 9:1 between the toner and the carrier, i.e., the carrier mixing ratio of 10% is used.

When the developer is supplied, the amount of the developer in the developing container 20 gradually increases with the image formation. This is because the toner is consumed by the image formation, but the carrier is not consumed but remains and continuously circulates in the developing container 20. In the case where the developer amount in the developing container 20 increases, a developer surface of the developer in the developing chamber 21*a* and the stirring chamber 21*b* raises (increases in developer surface height). When the developer surface raises at this time, of the developer fed by the first spiral portion 301, an amount of the developer returned back by the second spiral portion 302 decreases. For that reason, the developer in a large amount gets over the second spiral portion 302 to pass through the discharge opening 305, and then is fed by the third spiral portion 303 and is discharged through the discharge opening 306. Thus, in the case where the developer amount in the developing container 20 increases, the developer in a relatively large amount is discharged, and therefore the developer surface (height) of the developer in the stirring chamber 21*b* lowers. Then, of the developer fed by the first spiral portion 301, the amount of the developer returned back by the second spiral portion 302 increases. For that reason, most of the developer cannot get over the second spiral portion 302, so that the developer does not pass through the discharge opening 305. That is, the amount (discharge amount) of the developer to be discharged decreases. In this manner, the developer amount in the developing container 20 can be maintained at a constant level.

For example, when the length of the second spiral portion 302 is excessively long, the discharge of the developer supplied more than necessary, so that the developer amount in the developing container 20 becomes excessively large and therefore a lowering in developer charging performance can advance. On the other hand, when the length of the second spiral portion 302 is excessively short, the discharge of the developer is accelerated more than necessary, so that the developer amount in the developing container 20 becomes excessively small and therefore the coating amount of the developer on the developing sleeve 24 can become unstable. For that reason, the length, the diameter and the pitch of the second spiral portion 302 are appropriately changed depending on a constitution and a discharge condition of the developing device 104, the developer amount in the developing container 20 and a target discharge amount.

In the developing device 104, in order to sufficiently fix the developer (image) on the recording material when thick paper printing is effected for example, control for switching the process speed is effected in some cases. For example, in an operation in a thick paper mode, the process speed is changed from 120 mm/sec in an operation in a non-thick paper mode to 60 mm/sec which is ½ speed of 120 mm/sec in some cases. In the case where the process speed is switched, also the rotational speed of the developing screw 22*a* and the stirring screw 22*b* is switched from 250 rpm before the switching of the process speed to ½ speed=125 rpm. In this manner, in the case where the developing screw 22*a* and the stirring screw 22*b* are capable of rotating at a plurality of rotational speeds in a switching manner, the amount of the developer reaching the discharge opening 305 fluctuates depending on the switching of the rotational speed. That is, the developer discharge amount changes, so that the developer amount in the developing container 20 is liable to fluctuate.

Figure 4:
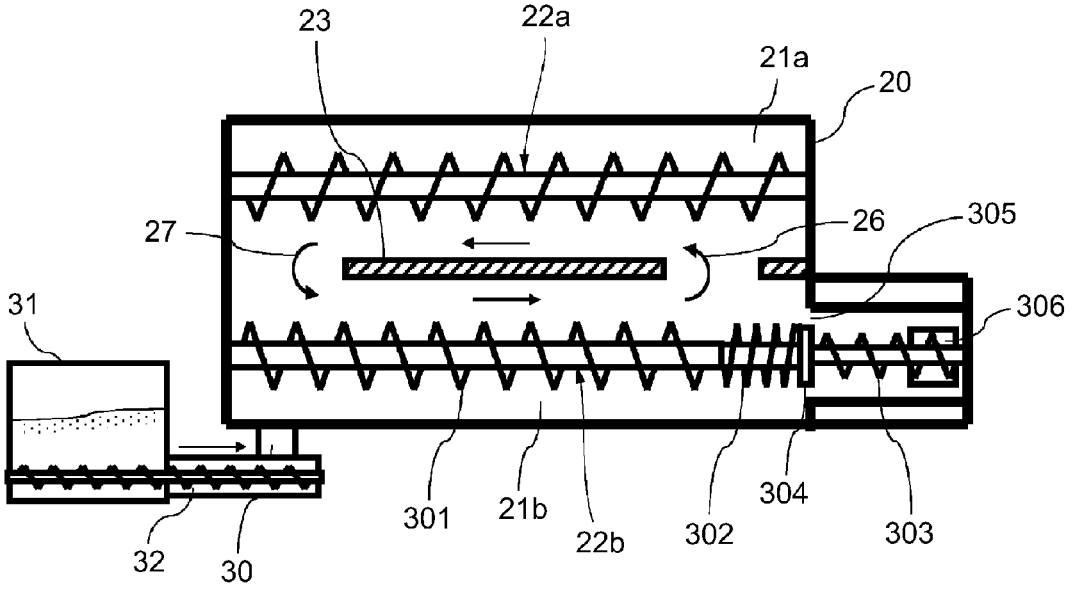
FIG. 4 is a sectional view of an upper surface structure of the developing device in cross-section parallel to the shaft with respect to an axial direction.
Figure 5:
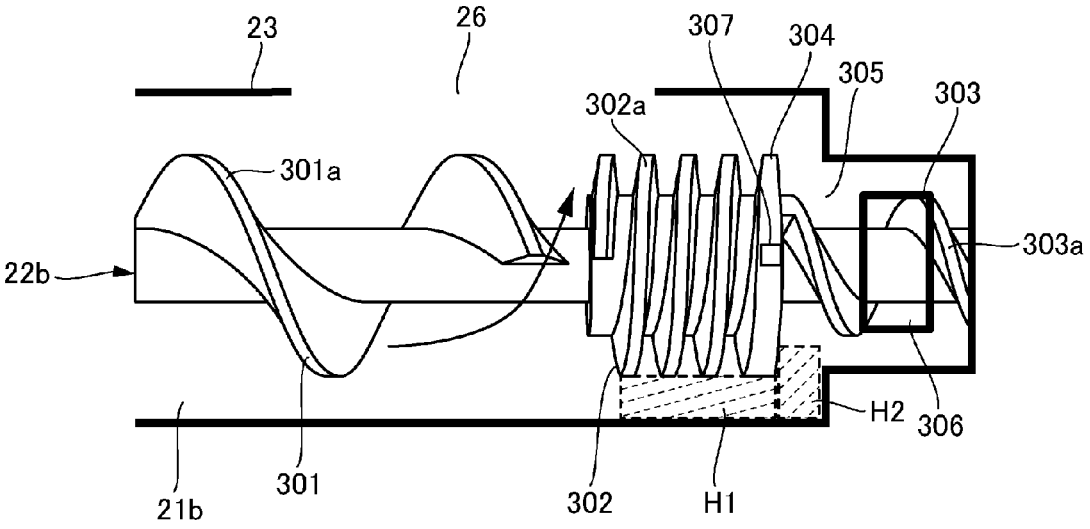
FIG. 5 is a partially enlarged top view of a stirring screw in an embodiment.

In the developing device 104 in this embodiment, as shown in FIGS. 4 and 5, the disk-shaped flange portion 304 (disk portion) is provided between the second spiral portion 302 and the third spiral portion 303 so as to cover the discharge opening 305. As a result, the fluctuation in developer amount in the developing container 20 with switching of the process speed is suppressed. A connecting portion of the third feeding blade 303*a* of the third spiral portion 303 is a portion, as a connecting portion, where the third feeding blade 303*a* is connected with the flange portion 304.

The flange portion 304 as the disk portion decreases a difference in force of inertia, exerted on the developer fed toward the discharge opening 305, generated due to a difference in feeding power between the first spiral portion 301 and the second spiral portion 302 before and after the switching of the rotational speed of the stirring screw 22*b*. As a result, depending on the switching of the rotational speed, the fluctuation in developer amount of the developer reaching the discharge opening 305 is suppressed. Further, the flange portion 304 decreases the amount of the developer falling through the discharge opening 305 in the neighborhood of the second feeding blade 302*a* at an upstreammost position of the second spiral portion 302 with respect to the feeding direction of the second spiral portion 302. Further, the flange portion 304 covers an end portion of the second spiral portion 302 on the discharge opening 305 side to prevent a valley portion of the second feeding blade 302*a* from exposing toward the discharge opening 305, so that the flange portion 304 lowers the amount of the developer passing through the discharge opening 305 via the valley portion of the second feeding blade 302*a*. Thus, even when the rotational speed of the stirring screw 22*b* fluctuates, the developer can be discharged in a certain discharge amount with no fluctuation in discharge amount.

However, when the flange portion 304 was provided simply, the discharge amount lowered compared with the supply amount, and thus the developer amount in the developing container 20 fluctuated in some cases. That is, in the developing device 104, circulation of the developer in the developing container 20 is repeated with continuous image formation, so that the flowability of the developer in the developing container 20 changes every moment. For example, in the case where image formation with a low print ratio is continuously effected for a long time, the amount of the developer moving from the developing container 20 to the photosensitive drum 101 is small. For that reason, the developer in the developing container 20 is repetitively subjected to stirring by the developing screw 22*a* and the stirring screw 22*b* and rubbing with the regulating blade 25 for a long time. As a result, the external additive is detached from the toner surface or is buried in the toner surface, so that a degree of exposure of the toner resin material becomes conspicuous. As a result, a degree of binding of the toner strengthens and therefore the flowability of the developer lowers. Particularly, in the pulverization toner, the external additive is added for imparting the flowability, and therefore the flowability of the developer is liable to be extremely lower. Further, in the high temperature/high humidity environment, the toner resin material softens and the above-described detachment or burying of the external additive is liable to generate, so that the flowability of the developer further lowers.

When the flowability of the developer in the stirring chamber 21*b* lowers, at a gap portion H1 between the developing container 20 and the second spiral portion 302, the developer is liable to stagnate (FIG. 5). When the developer stagnates at the gap portion H1, the amount of the developer which gets over the flange portion 304 and the discharge opening 305 and which is fed to the discharge opening (port) 306 decreases. That is, on the downstream side of the second spiral portion 302 with respect to the feeding direction, the developer is liable to be influenced by a feeding force of the first spiral portion 301, and therefore the speed of the developer flowing toward the discharge opening 305 is large. On the other hand, on the upstream side of the second spiral portion 302 with respect to the feeding direction, the developer is not readily influenced by the feeding force of the first spiral portion 301, and therefore the speed of the developer flowing toward the discharge opening 305 is small. For that reason, when the flowability of the developer lowers, particularly on a side close to the discharge opening 305 at the gap portion H1, in combination with opening friction with the wall of the developing container 20 and the stirring screw 22*b*, the developer stagnates and thus is liable to generate an agglomerate (aggregate). When the agglomerate generates, the agglomerate obstructs the feeding of the developer, with the result that the discharge amount can lower.

Therefore, in the developing device 104 in this embodiment, as shown in FIG. 5, on an outer peripheral surface of the flange portion 304, a projected portion 307 projecting in the radial direction is provided. The first spiral portion 301 is 16 mm in diameter including the first feeding blade 301*a*, 20 mm in pitch of the first feeding blade 301*a*, and 6 mm in shaft diameter. The second spiral portion 302 is 16 mm in diameter including the second feeding blade 302*a*, 3 mm in pitch of the second feeding blade 302*a*, and 11 mm in shaft diameter. The third spiral portion 303 is 10 mm in diameter including the third feeding blade 303*a*, 10 mm in pitch of the third feeding blade 303*a*, and 6 mm in shaft diameter. The flange portion 304 is formed in a disk shape of 16 mm in diameter and 1 mm in thickness, and thus has the same diameter as the second spiral portion 302. On the other peripheral surface of this flange portion 304, the projected portion 307 which is a rectangular parallelopiped having an area of 1 mm×1 mm and a radial height of 0.5 mm is provided. A clearance between the inner wall of the developing container 20 and each of the second spiral portion 302 and the flange portion 304 is 1 mm. In this case, a clearance between the inner wall of the developing container 20 and the projected portion 307 is 0.5 mm. A gap between the discharge opening 305 and the flange portion 304 (i.e., a gap with respect to the rotational direction of the stirring screw 22*b*) is 3 mm. As a result, the above-described problem caused by the generation of the agglomerate at the gap portion H1 was able to be solved.

Figure 6:
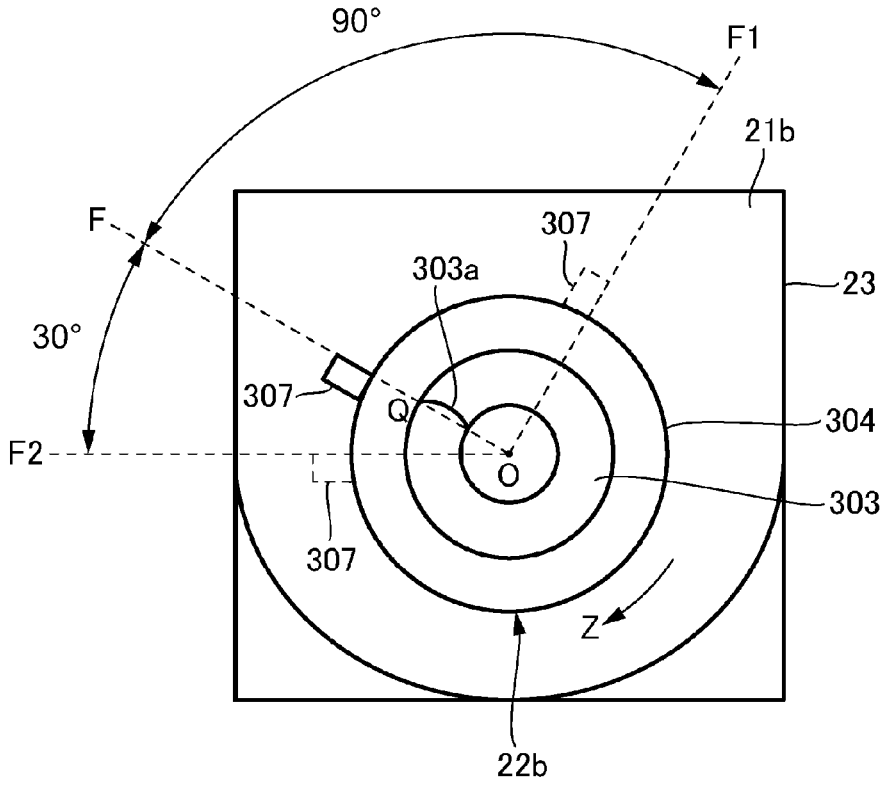
FIG. 6 is a side view for illustrating a projected portion in the embodiment.
Figure 7:
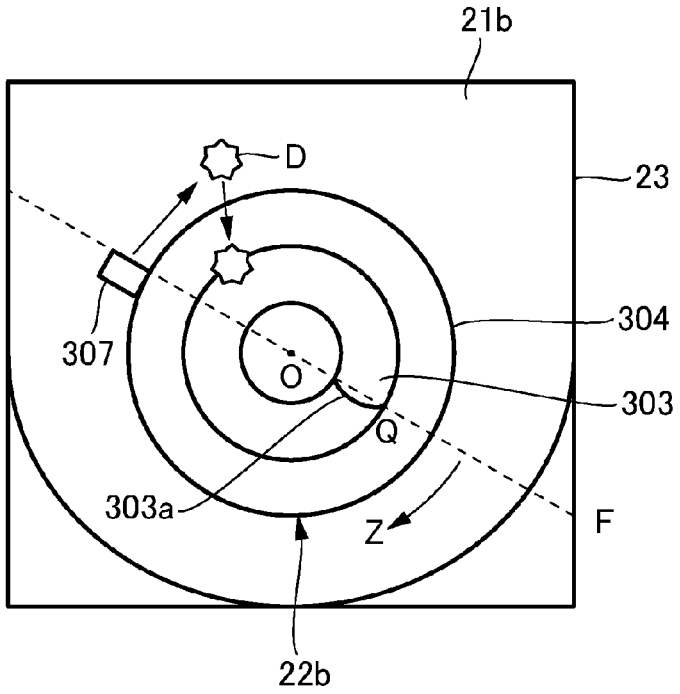
FIG. 7 is a side view for illustrating a projected portion in a comparison example.

However, a point of importance in the developing device 104 is not only in that the flange portion 304 is simply provided with the projected portion 307 but also in that the projected portion 307 is provided at what position on the flange portion 304 on the basis of a positional relationship with the third feeding blade 303*a* of the third spiral portion 303. This will be described using FIGS. 6 and 7. FIG. 6 is a schematic view for illustrating the projected portion 307 in the developing device 104 in this embodiment, and FIG. 7 is a schematic view of a projected portion 307 in a developing device in a comparison example. Each of FIGS. 6 and 7 is a side view of the stirring screw 22*b* as seen from a downstream side of the third spiral portion 303 with respect to the feeding direction of the third spiral portion 303. However, for easy understanding, with respect to the third feeding blade 303*a*, only a side contacting the flange portion 304 (i.e., the upstream end side of the third spiral portion 303 with respect to the feeding direction of the third flange portion 303) is roughly illustrated.

In the developing device 104 in this embodiment, as shown in FIG. 6, the projected portion 307 is provided on an extension line of a line F connecting a rotation shaft center O of the stirring screw 22*b* and a connecting end portion Q of the third feeding blade 303*a* of the third spiral portion 303 on the side contacting the flange portion 304. In other words, when the stirring screw 22*b* is seen from the rotation shaft center O thereof, the projected portion 307 is provided so that a phase of the projected portion 307 and a phase (starting phase) of the connecting end portion Q of the third feeding blade 303*a* of the third spiral portion 303 are disposed at the same phase position. The projected portion 307 has a width with respect to a circumferential direction, and therefore in this embodiment, a position of an end portion of the projected portion 307 on a downstream side with respect to a rotational direction (arrow Z direction in FIG. 6) of the flange portion 304 refers to the phase of the projected portion 307 for convenience.

The comparison example is shown in FIG. 7 and has a constitution in which the position 307 is provided with a phase deviated by 180 degrees from the starting phase of the third spiral portion 303. When the present inventors conducted an experiment, it was confirmed that in this constitution, although the projected portion 307 was provided, the discharge amount of the developer extremely lowered in such a case that the flowability of the developer further lowered by image formation effected for a further long time or image formation under a high temperature/high humidity environment. This phenomenon was generated by stagnation of a part of the developer, getting over the second spiral portion 302 and the flange portion 304 and reaching the discharge opening 305, at a gap portion H2 without being fed by the third spiral portion 303. When the cause of the stagnation of the developer at the gap portion H2 was investigated specifically, the following phenomenon generated. That is, with rotation (in arrow Z direction in FIG. 7) of the stirring screw 22*b*, the projected portion 307 raises the developer stagnating at the gap portion H1, a part of the developer is caught by the valley portion of the second feeding blade 302*a* of the second spiral portion 302, and then is fed by the second spiral portion 302 in the opposite direction to a direction toward the discharge opening 305. This part of the developer is particularly of no problem.

On the other hand, most of the raised developer falls on the rotational shaft of the third spiral portion 303 (as indicated by a symbol D in FIG. 7). The rotational direction of the third spiral portion 303 is the same direction as the rotational direction (arrow Z direction in FIG. 7) of the stirring screw 22*b*. An angle from the phase of the projected portion 307 to the starting phase of the third spiral portion 303 is 180 degrees as described above. In such a constitution, a time difference generates by any means until the third feeding blade 303*a* of the third spiral portion 303 rotates and scoops up the developer D which is raised by the projected portion 307 and which then falls on the rotation shaft of the third spiral portion 303. For that reason, the developer which has fallen on the rotation shaft of the third spiral portion 303 slips and falls along the rotation shaft by gravitation before the third feeding blade 303*a* rotates and starts feeding, and therefore accumulates and stagnates at the gap portion H2 (FIG. 5). Particularly, as can be understood from FIG. 5, in the stirring chamber 21*b*, a cross-sectional area on the third spiral portion 303 side with respect to the flange portion 304 (i.e., a cross-sectional area of the discharge opening 305) is smaller than a cross-sectional area on the second spiral portion 302 side with respect to the flange portion 304. For that reason, the developer is liable to inevitably stagnate in the neighborhood of the gap portion H2. In this way, the developer raised by rotation of the projected portion 307 and falling on the rotation shaft of the third spiral portion 303 stagnates at the gap portion H2 unless the developer is fed by the third feeding blade 303*a* as early as possible, thus newly causing impairment of the discharge of the developer.

Therefore, the present inventors made the phase of the projected portion 307 and the starting phase of the third spiral portion 303 the same in order to prevent the impairment of the discharge of the developer caused due to the stagnation of the developer. As a result, the projected portion 307 abuts against the agglomerate of the developer generated at the gap portion H1 with the rotation of the third spiral portion 303 (specifically in the stirring screw 22*b*) and collapses the agglomerate. Of the developer forming the agglomerate, the developer fallen on the rotation shaft of the third spiral portion 303 is immediately scooped by the third feeding blade 303*a* rotating in a feedable manner and then is fed by the third spiral portion to be discharged to an outside of the developing container.

The present inventors considered that even when the phase of the projected portion 307 and the starting phase of the third spiral portion 303 are not the same, it would be possible to scoop and feed the developer by the third feeding blade 303*a* until the developer raised by the projected portion 307 falls into the gap portion H1. Therefore, in order to further study a positional relationship between the phase of the projected portion 307 and the starting phase of the third spiral portion 303, the present inventors conducted an experiment. An experimental result is shown in Table 1 below. In this experiment, in the case where the phase of the projected portion 307 was deviated from the starting phase of the third spiral portion 303 in 10-degree increment, an amount (discharge amount) of the developer discharged through the discharge opening (port) 306 was checked. The rotational speed of the stirring screw 22*b* in the experiment was the ½ speed=125 rpm after the switching of the process speed. In Table 1, on the basis of the starting phase of the third spiral portion 303, the phase on the downstream side with respect to the rotational direction of the flange portion 304 is represented by a positive value, and the phase on the upstream side with respect to the rotational direction of the flange portion 304 is represented by a negative value.

TABLE 1

| PPSA*1 | −40 | −30 | −20 | −10 | 0 | 10 | 20 | 30 |
|---|---|---|---|---|---|---|---|---|
| DDA*2 | x | Δ | Δ | ○ | ○ | ○ | ○ | ○ |

TABLE 1-continued

| PPSA*1 | 40 | 50 | 60 | 70 | 80 | 90 | 100 |
|---|---|---|---|---|---|---|---|
| DDA*2 | Δ | Δ | Δ | Δ | Δ | Δ | x |

*1"PPSA" is a projected portion set angle (phase) (degrees).
*2"DDA" is a developer discharge amount.
"○" is good,
"Δ" is somewhat good (acceptable), and
"x" is unacceptable.

From the experimental result of Table 1, in the case where the projected portion 307 was provided at a position deviated from the starting phase of the third spiral portion 303 by 100 degrees (+100 degrees) or more on the downstream side with respect to the rotational direction of the flange portion 304, it was confirmed that the developer discharge amount extremely decreased. Also in the case where the projected portion 307 was provided at a position deviated from the starting phase of the third spiral portion 303 by 40 degrees (−40 degrees) or more on the upstream side with respect to the rotational direction of the flange portion 304, it was confirmed that the developer discharge amount extremely decreased. Further, in the case where the projected portion 307 was provided at a position deviated from the starting phase of the third spiral portion 303 within a range from 90 degrees (+90 degrees) to 40 degrees (+40 degrees) on the downstream side with respect to the rotational direction of the flange portion 304, it was confirmed that the developer discharge amount somewhat decreased. Also in the case where the projected portion 307 was provided at a position deviated from the starting phase of the third spiral portion 303 within a range from 20 degrees (−20 degrees) to 30 degrees (−30 degrees) on the upstream side with respect to the rotational direction of the flange portion 304, it was confirmed that the developer discharge amount somewhat decreased. Further, in the case where the projected portion 307 was provided at a position deviated from the starting phase of the third spiral portion 303 within a range from 30 degrees (+30 degrees) to 0 degrees on the downstream side with respect to the rotational direction of the flange portion 304, it was confirmed that the developer discharge amount little decreased. Also in the case where the projected portion 307 was provided at a position deviated from the starting phase of the third spiral portion 303 within a range from 0 degrees to 10 degrees (−10 degrees) on the upstream side with respect to the rotational direction of the flange portion 304, it was confirmed that the developer discharge amount little decreased. From such an experimental result, it can be understood that when the projected portion 307 is provided at a position deviated from the starting phase of the third spiral portion 303 within a range from +90 degrees to −30 degrees, the stagnation of the developer does not readily generate and thus the decrease in discharge amount of the developer can be suppressed. In FIG. 6, the range from +90 degrees to −30 degrees was illustrated by rectilinear lines F1 and F2 for convenience.

The case where the projected portion 307 is provided within the range deviated from the starting phase of the third spiral portion 303 to the position by 90 degrees (+90 degrees) on the downstream side with respect to the rotational direction of the flange portion 304 will be described. In this case, until the developer raised by the projected portion 307 falls into the gap portion H2, it is possible to ensure a rotation time enough to scoop and feed the developer by the third feeding blade 303*a*. On the other hand, when the projected portion 307 is provided at a position deviated by +90 degrees or more, it is impossible to ensure the sufficient rotation time until the raised developer is scooped, so that the developer falls into the gap portion H2 until the third feeding blade 303*a* reaches the position. Accordingly, in the case where the projected portion 307 is provided on the downstream side with respect to the rotational direction of the flange portion 304, there is a need to provide the projected portion 307 within a range of 90 degrees from the starting phase of the third spiral portion 303.

Next, the case where the projected portion 307 is provided within the range deviated from the starting phase of the third spiral portion 303 to the position by 30 degrees (+30 degrees) on the downstream side with respect to the rotational direction of the flange portion 304 will be described. In this case, the developer raised by the projected portion 307 falls on the rotation shaft of the third spiral portion 303 on a side upstream of the phase of the projected portion 307 with respect to the rotational direction of the flange portion 304. For that reason, when the projected portion 307 is provided within the range from the starting phase of the third spiral portion 303 to the position by −30 degrees, the developer falling on the rotation shaft of the third spiral portion 303 can be scooped and fed by the third feeding blade 303*a*. On the other hand, when the projected portion 307 is provided at a position deviated by −30 degrees or more, there is a need to wait 360-degree rotation, i.e., one full turn of the flange portion 304, until the third feeding blade 303*a* scoops and feed the developer fallen on the rotational shaft of the third spiral portion 303. However, after the rotation of one full turn, the developer has already slipped and fallen along the rotation shaft of the third spiral portion 303, so that the third feeding blade 303*a* cannot scoop and embody the developer. Accordingly, in the case where the projected portion 307 is provided on the upstream side with respect to the rotational direction of the flange portion 304, there is a need to provide the projected portion 307 within a range of 30 degrees from the starting phase of the third spiral portion 303.

From the above, in the case where the projected portion 307 is provided on the downstream side with respect to the rotational direction of the flange portion 304, the projected portion 307 is provided in a range from the starting phase of the third spiral portion 303 to the position of 90 degrees. Further, in the case where the projected portion 307 is provided on the upstream side with respect to the rotational direction of the flange portion 304, the projected portion 307 is provided in a range from the starting phase of the third spiral portion 303 to the position of 30 degrees. That is, in the developing device 104 in this embodiment, the projected portion 307 is provided within a range of 90 degrees from the starting phase of the third spiral portion 303 on the downstream wide with respect to the rotational direction of the flange portion 304 and 30 degrees from the starting phase of the third spiral portion 303 on the upstream side with respect to the rotational direction of the flange portion 304. As a result, the developer which is fed at the flange portion 304 in the circumferential direction by the projected portion 307 and which falls on the third spiral portion 303 is scooped by the third feeding blade 303*a* before the developer falls into the gap portion H2, and then can be fed to the discharge opening 306 without causing scooping failure. Accordingly, it is possible to prevent stagnation of the developer at the gap portion H2, with the result the decrease in discharge amount of the developer can be suppressed. That is, even when the flowability of the developer lowers, the discharge of the developer can be stably effected.

Incidentally, the peripheral speed of the flange portion 304, i.e., the peripheral speed of the stirring screw 22*b* may preferably be in a range of 80 mm/sec or more and 600 mm/sec or less from the viewpoints of the feeding property and temperature rise. When the peripheral speed of the stirring screw 22*b* (the flange portion 304) falls within this range, the developer raised by the projected portion 307 assumes substantially the same behavior irrespective of the peripheral speed. For that reason, when the projected portion 307 is provided in the above-described range from the starting phase of the third spiral portion 303, the stirring screw 22*b* can scoop up the developer raised by the projected portion 307, so that the above-described effect can be sufficiently obtained.

Other Embodiments

In the above-described embodiment, the projected portion 307 was provided in the range from +90 degrees to −30 degrees (FIG. 6) on the basis of the starting phase of the third spiral portion 303, but the present invention is not limited thereto. The projected portion 307 may also be provided within a narrower range, e.g., within a range from +30 degrees to −10 degrees. When the projected portion 307 is provided within a range closer to the starting phase of the third spiral portion 303, the developer can be scooped with high reliability. When the present inventors conducted a detailed experiment, it was confirmed that the projected portion 307 was preferably provided within a range from +5 degrees to −5 degrees on the basis of the starting phase of the third spiral portion 303.

The shape of the projected portion 307 is not limited to the above-described rectangular parallelopiped but may also be a triangular shape for example.

In the above-described embodiments, the image forming apparatus 1 having the constitution in which the toner images are primary-transferred from the photosensitive drums 101Y to 101K onto the intermediary transfer belt 121 and then the composite color toner images are secondary-transferred collectively onto the recording material P was described, but the present invention is not limited thereto. For example, an image forming apparatus of a direct transfer type in which the toner images are directly transferred from the photosensitive drums 101Y to 101K onto the recording material P carried and fed by a transfer material feeding belt may also be used. The photosensitive drums 101Y to 101K is not limited to the drum-shaped photosensitive member, but may also be a belt-shaped photosensitive member. Further, the charging type, the transfer type, the cleaning type and the fixing type are also not limited to the above-described types.

In the above-described embodiments, the developing device of the horizontal stirring type in which the developing container 20 is partitioned horizontally into the developing chamber 21*a* and the stirring chamber 21*b*, but the present invention is not limited thereto. The present invention is also applicable to a developing device of a vertical stirring type in which the developing container 20 is partitioned vertically into the developing chamber 21*a* and the stirring chamber 21*b*.

In the above-described embodiment, the developing device using the two-component developer containing the toner and the carrier was described as an example, but the present invention is not limited thereto. A developing device using the one-component toner containing the toner alone may also be employed.

According to the present invention, even when the flowability of the developer lowers, the developer can be smoothly fed without causing the formation of the agglomerate thereof and without causing catching failure, and therefore the discharge of the developer can be stably performed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-010627 filed on Jan. 22, 2015, which is hereby incorporated by reference herein in its entirety.

What is claimed is:

1. A developing device comprising:

a developer carrying member for carrying and feeding a developer;

a first chamber for supplying the developer to said developer carrying member;

a second chamber for forming a circulation path of the developer in communication with said first chamber and for delivering the developer between itself and said first chamber;

a first feeding member, provided rotatably in said first chamber, for feeding the developer in said first chamber; and a second feeding member, provided rotatably in said second chamber, for feeding the developer in said second chamber, wherein said second feeding member comprises, a first spiral portion including a first spiral feeding blade for feeding the developer in said second chamber in a feeding direction opposite to a feeding direction in said first chamber, a second spiral portion including a second spiral feeding blade for feeding a part of the developer fed by said first spiral portion in a feeding direction opposite to the feeding direction of said first spiral portion, a third spiral portion including a third spiral feeding blade for feeding the developer fed by getting over said second spiral portion in the same feeding direction as the feeding direction of said first spiral portion, and a disk portion provided between said second spiral portion and said third spiral portion, wherein said disk portion includes a projected portion projected from a part of an outer peripheral surface of said disk portion in a radial direction, and wherein when said disk portion is seen in an axial direction of said second feeding member, on the basis of a line connecting a rotation center of said disk portion and an upstream end portion of said third spiral portion with respect to the feeding direction of said third spiral portion, said projected portion is provided within a range from a position deviated by 90 degrees toward a downstream side with respect to a rotational direction of said disk portion to a position deviated by 30 degrees toward an upstream side with respect to the rotational direction of said disk portion.

2. A developing device according to claim 1, wherein said projected portion is provided within a range from a position deviated by 30 degrees toward the downstream side with respect to the rotational direction of said disk portion to a position deviated by 10 degrees toward the upstream side with respect to the rotational direction of said disk portion.

3. A developing device according to claim 1, wherein said projected portion is provided within a range from a position deviated by 5 degrees toward the downstream side with respect to the rotational direction of said disk portion to a position deviated by 5 degrees toward the upstream side with respect to the rotational direction of said disk portion.

4. A developing device according to claim 1, wherein said projected portion is provided on an extension line of a line connecting the rotation center of said disk portion and a connecting end portion of said third spiral feeding blade.

5. A developing device according to claim 1, wherein said second feeding member rotates so that a peripheral speed of said disk portion is 80 mm/s or more and 600 mm/s or less.

6. A developing device according to claim 1, wherein said second chamber is formed so that a cross-sectional area thereof on a downstream side with respect to the feeding direction of said third spiral portion is smaller than a cross-sectional area thereof on an upstream side with respect to the feeding direction of said third spiral portion.

7. A developing device according to claim 1, wherein said second chamber includes a discharge opening for permitting discharge of the developer on a downstream side with respect to the feeding direction of said third spiral portion.

* * * * *